US008686808B2

(12) United States Patent
Rhodes

(10) Patent No.: US 8,686,808 B2
(45) Date of Patent: Apr. 1, 2014

(54) BAND COMBINING FILTER

(75) Inventor: John David Rhodes, Menston (GB)

(73) Assignee: Filtronic Wireless Ltd, Shipley (GB)

( * ) Notice: Subject to any disclaimer, the term of this patent is extended or adjusted under 35 U.S.C. 154(b) by 411 days.

(21) Appl. No.: 13/151,029

(22) Filed: Jun. 1, 2011

(65) Prior Publication Data

US 2012/0306590 A1 Dec. 6, 2012

(51) Int. Cl.
*H01P 5/12* (2006.01)
*H01P 3/08* (2006.01)

(52) U.S. Cl.
USPC ..... 333/117; 333/110

(58) Field of Classification Search
USPC ..... 333/109, 110, 111, 112, 116, 117
See application file for complete search history.

(56) References Cited

U.S. PATENT DOCUMENTS

| | | | | |
|---|---|---|---|---|
| 3,400,339 | A | 9/1968 | Shone | |
| 7,623,005 | B2 * | 11/2009 | Johansson et al. | 333/110 |
| 8,228,135 | B2 * | 7/2012 | Rhodes | 333/110 |
| 8,324,981 | B2 * | 12/2012 | Ohi et al. | 333/25 |
| 2009/0231056 | A1 | 9/2009 | Rhodes | |

FOREIGN PATENT DOCUMENTS

| | | |
|---|---|---|
| FR | 1442904 | 5/1966 |
| GB | 2444786 | 6/2008 |
| GB | 2476868 | 7/2011 |
| JP | 08250905 | 9/1996 |

OTHER PUBLICATIONS

Great Britain Search Report, Application No. GB1109201.2, Sep. 18, 2012, three pages.
English language abstract not available for FR1442904; however see English language equivalent US 3,400,339.
Machine translation for JP08-250905, extracted on Nov. 1, 2012, 24 pages.

* cited by examiner

*Primary Examiner* — Dean O Takaoka
(74) *Attorney, Agent, or Firm* — Howard & Howard Attorneys PLLC

(57) ABSTRACT

A band combining filter for filtering a microwave signal having at least one band edge at a band edge transition frequency. The filter comprises a plurality of filter sections. Each filter section comprising 3dB hybrid couplers having input ports and output ports and resonators connected between the input ports and the output ports of the couplers.

The filter sections are connected in cascade such that the outputs of one filter section are connected to the inputs of the next filter section in the cascade.

A subset of the filter sections are high Q filter sections with the Q values of the resonators of those filter sections having values each of which are at least a factor of three higher than the Q values of the resonators of the remaining filter sections.

12 Claims, 9 Drawing Sheets

$Y_1 = (\sqrt{2} - 1)p$ $Y_2 = (\sqrt{2} + 1)p$ $Y_0 = 2(\sqrt{2} - 1)^2$

BAND COMBINING FILTER

BACKGROUND

The present invention relates to a band combining filter. More particularly, but not exclusively, the present invention relates to a band combining filter comprising a plurality of filter sections connected together in cascade along with a phase shifter, the filter sections including resonators and at least one of the filter sections being a high Q filter section.

Band combining filters are known. Such band combining filters can include a plurality of resonators. In the case of a rapid transition from passband to stopband the resistive loss of the resonators causes a roll off of the insertion loss into the passband. In order to meet typical rejection requirements unloaded Qs of greater than 20,000 are required resulting in the necessity, at microwave frequencies to use dielectric resonators for all of the cavities resulting in a physically large heavy and expensive filter.

The present invention seeks to overcome the problems of the prior art.

SUMMARY

Accordingly, in a first aspect, the present invention provides a band combining filter for filtering a microwave signal, the band combining filter having at least one band edge at a band edge transition frequency, the filter comprising a plurality of filter sections, each filter section comprising first and second 3 dB hybrid couplers, each 3 dB hybrid coupler comprising first and second input ports and first and second output ports;

a first resonator connected between the second input port of the first coupler and the first input port of the second coupler; and, a second resonator connected between the second output port of the first coupler and the first output port of the second coupler;

each filter section comprising first and second input ports defined by the first input port of its first coupler and the second input port of its second coupler respectively;

each filter section comprising first and second output ports defined by the first output port of its first coupler and second output port of its second coupler respectively;

the filter sections being connected in cascade with the first and second outputs of one filter section being connected to the first and second inputs of the next filter section in the cascade;

the band combining filter further comprising a coupled phase shifter in the cascade having first and second inputs adapted to receive microwave signals and provide them at output ports with a phase shift therebetween;

characterised in that a subset of the filter sections are high Q filter sections with the Q values of the resonators of those filter sections having values each of which are at least a factor of three higher than the Q values of the resonators of the remaining filter sections.

The band combining filter according to the invention requires only two high Q resonators per band edge and still has low loss across the entire passband.

The coupled phase shifter can be the last element of the cascade with the inputs of the phase shifter receiving the outputs from the final filter section of the cascade.

Alternatively, the coupled phase shifter can be arranged between filter sections in the cascade.

Preferably, the Q values of the resonators in the subset are at least four times, more preferably five times, that of each of the remaining resonators.

Preferably, for each filter section the Q value of the first resonator in the filter section is equal to the Q value of the second resonator in the same filter section.

Preferably, the number of high Q filter sections is equal to the number of band edges.

The band combining filter according to the invention can have one band edge.

The band combining filter according to the invention can comprise two filter sections connected in cascade.

The band combining filter according to the invention can comprise at least three, preferably four, filter sections in cascade.

Preferably, the band combining filter further comprises an electrical signal generator.

BRIEF DESCRIPTION OF THE DRAWINGS

The present invention will now be described by way of example only at not in any limitative sense with reference to the accompanying drawings in which.

DETAILED DESCRIPTION

Figure 1:
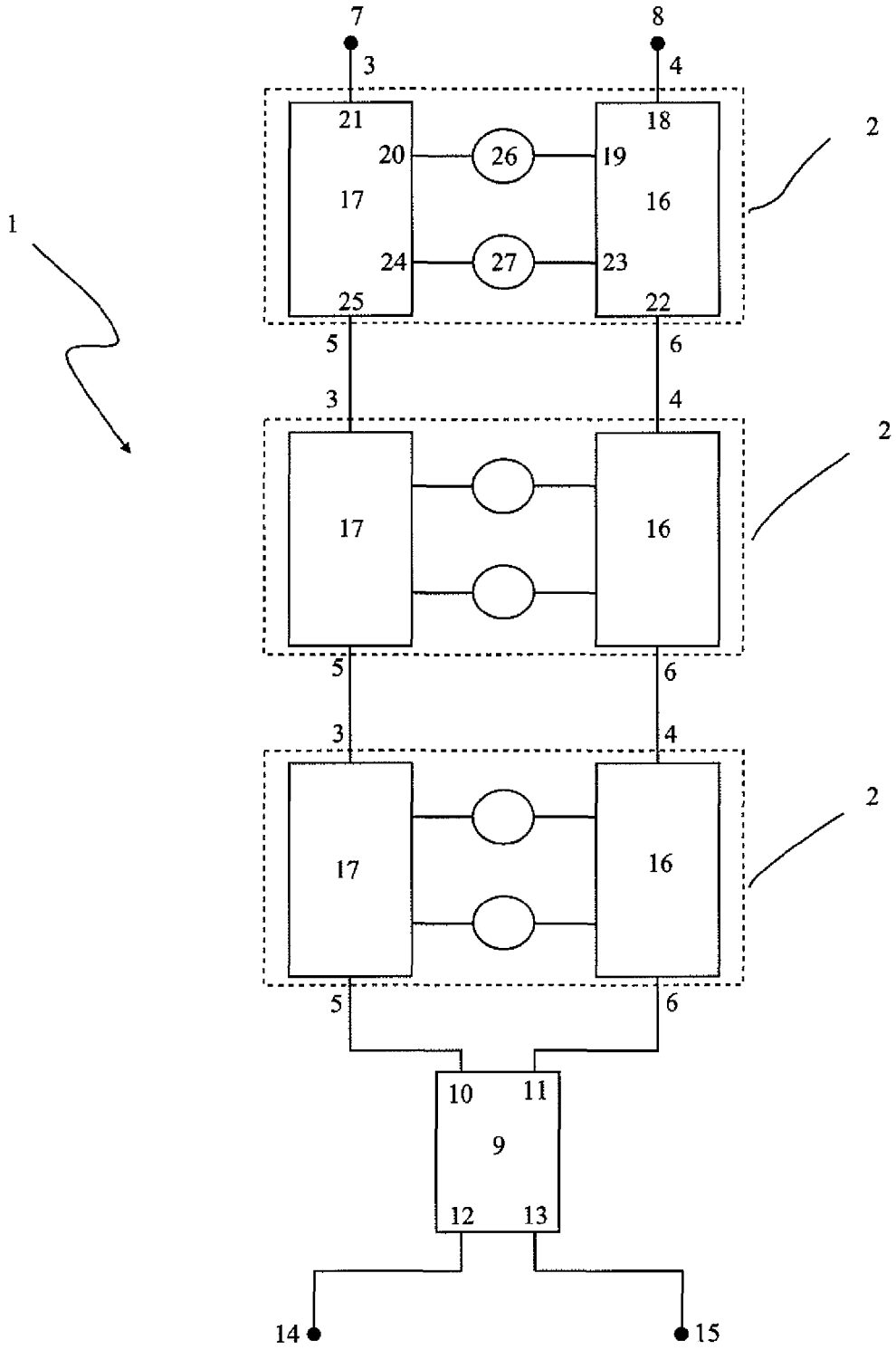
FIG. 1 shows a first embodiment of a band combining filter according to the invention.

Shown in FIG. 1 is a band combining filter 1 according to the invention. The filter 1 is a third order filter having a single band edge at a band edge transition frequency. The band combining filter 1 comprises a plurality (in this case three) filter sections 2 connected in cascade. Each filter section 2 comprises first and second input ports 3,4 and first and second output ports 5,6. The first and second output ports 5,6 of one filter section 2 are connected to the first and second input ports 3,4 of the next filter section 2 in the cascade as shown. The first and second input ports 3,4 of the first filter section 2 comprise the input ports 7,8 of the filter 1.

The output ports 5,6 of the last filter section 2 are connected to a coupled phase shifter 9. The signals received at the input ports 10,11 of the coupled phase shifter 9 are presented at the output ports 12,13 of the coupled phase shifter 9 with a phase difference introduced therebetween. The output ports 12,13 of the coupled phase shifter 9 are the output ports 14,15 of the filter 1. The function of the coupled phase shifter 9 is explained in more detail below.

Each filter section 2 comprises first 16 and second 17 3 dB hybrids. Each hybrid 16,17 has first and second input ports 18, 19, 20, 21 and first and second output ports 22, 23, 24, 25. The second input port 19 of the first hybrid 16 is connected to the first input port 20 of the second hybrid 17 by a first resonator 26. Similarly, the second output port 23 of the first hybrid 16 is connected to the first output port 24 of the second hybrid 17 by a second resonator 27. In this embodiment within each filter section 2 the first and second resonators 26,27 have the same value.

One of the filter sections 2 is a high Q filter section. The Q values of the resonators 26,27 in this section are a factor of four higher than the Q values of the resonators 26,27 in the remaining filter sections 2.

Even though the band combining filter 1 according to the invention has only two high Q value resonators 26,27 the combining filter 1 shows low loss across the entire passband.

In this embodiment the Q values of the resonators 26,27 of the high Q filter section 2 are a factor of four higher than the Q values of the resonators 26,27 of the remaining filter sections 2. More generally speaking, it is preferred that the Q values of the resonators 26,27 of the high Q filter sections 2 have values which are at least a factor of three, more preferably at least a factor of four, more preferably at least a factor of five larger than the Q values of the resonators 26,27 of the remaining filter sections 2.

The low Q value resonators 26,27 are typically realised as combline resonators. High Q resonators 26,27 are typically realised as ceramic resonators.

Figure 2:
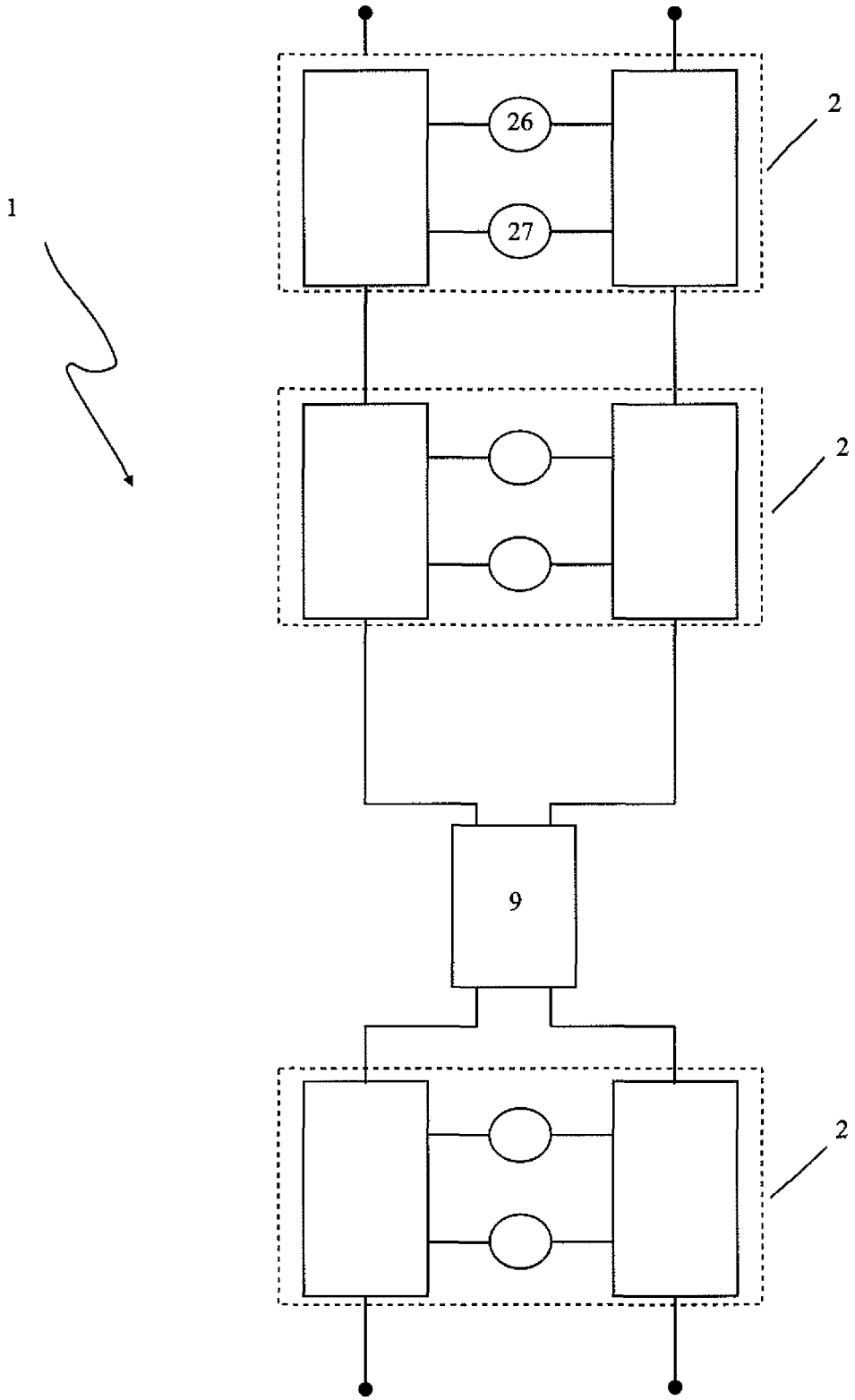
FIG. 2 shows a second embodiment of a band combining filter according to the invention.

Shown in FIG. 2 is a second embodiment of a band combining filter 1 according to the invention. This embodiment is similar to that of FIG. 2 except the coupled phase shifter 9 is included between filter sections 2 in the cascade. In this embodiment the high Q filter section 2 is the last filter section 2 in the cascade. More generally speaking, the coupled phase shifter 9 and the filter sections 2 can be arranged in any order in the cascade.

Figure 3:
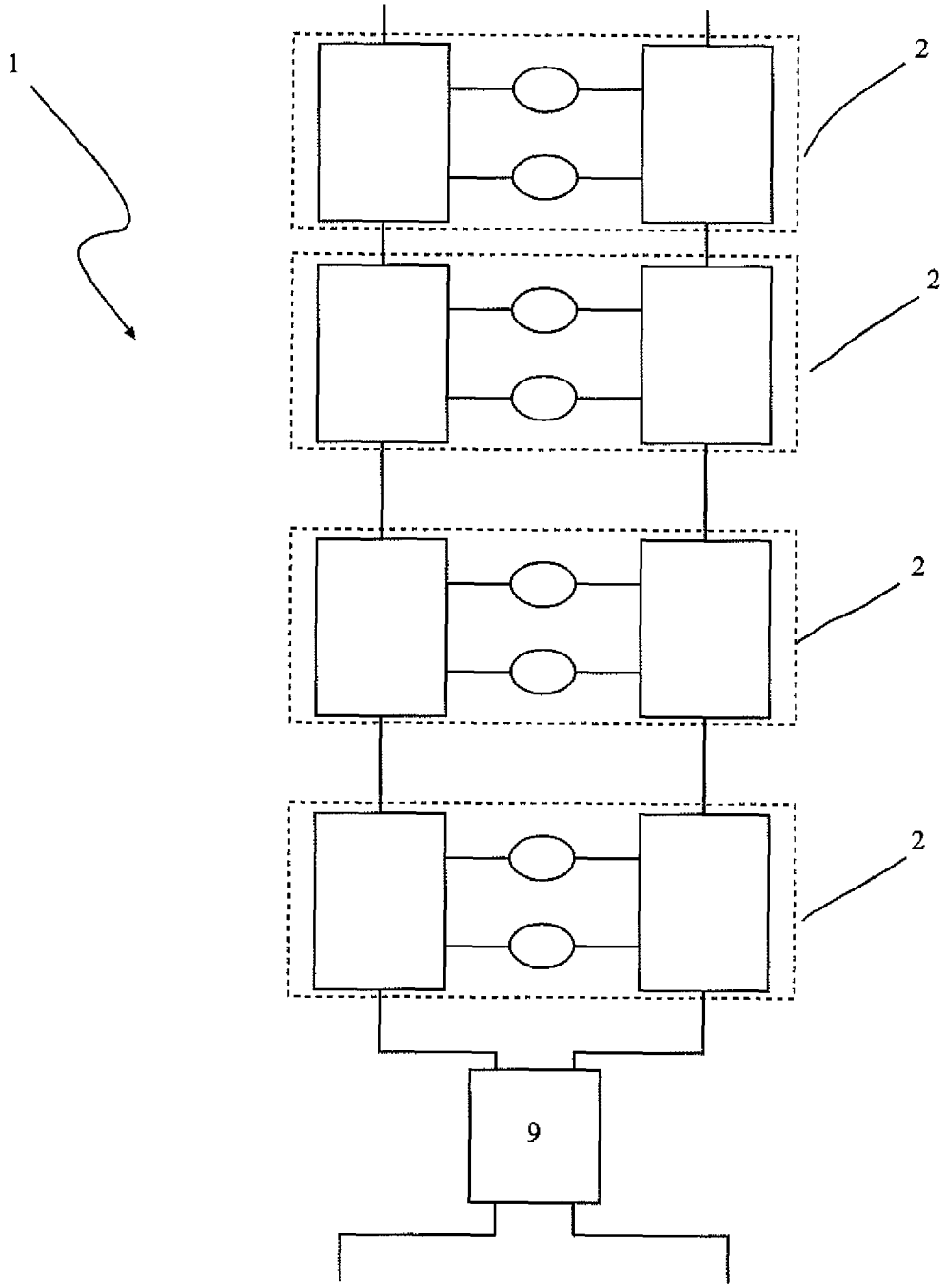
FIG. 3 shows a third embodiment of a band combining filter according to the invention.

Shown in FIG. 3 is a further embodiment of a band combining filter 1 according to the invention. This filter 1 is a fourth order filter and as such has four filter sections 2. The filter 1 has two band edges at band edge transition frequencies and accordingly has two high Q filter sections 2. Generally speaking it is preferred that the number of high Q filter sections 2 is equal to the number of band edges.

Figure 4:
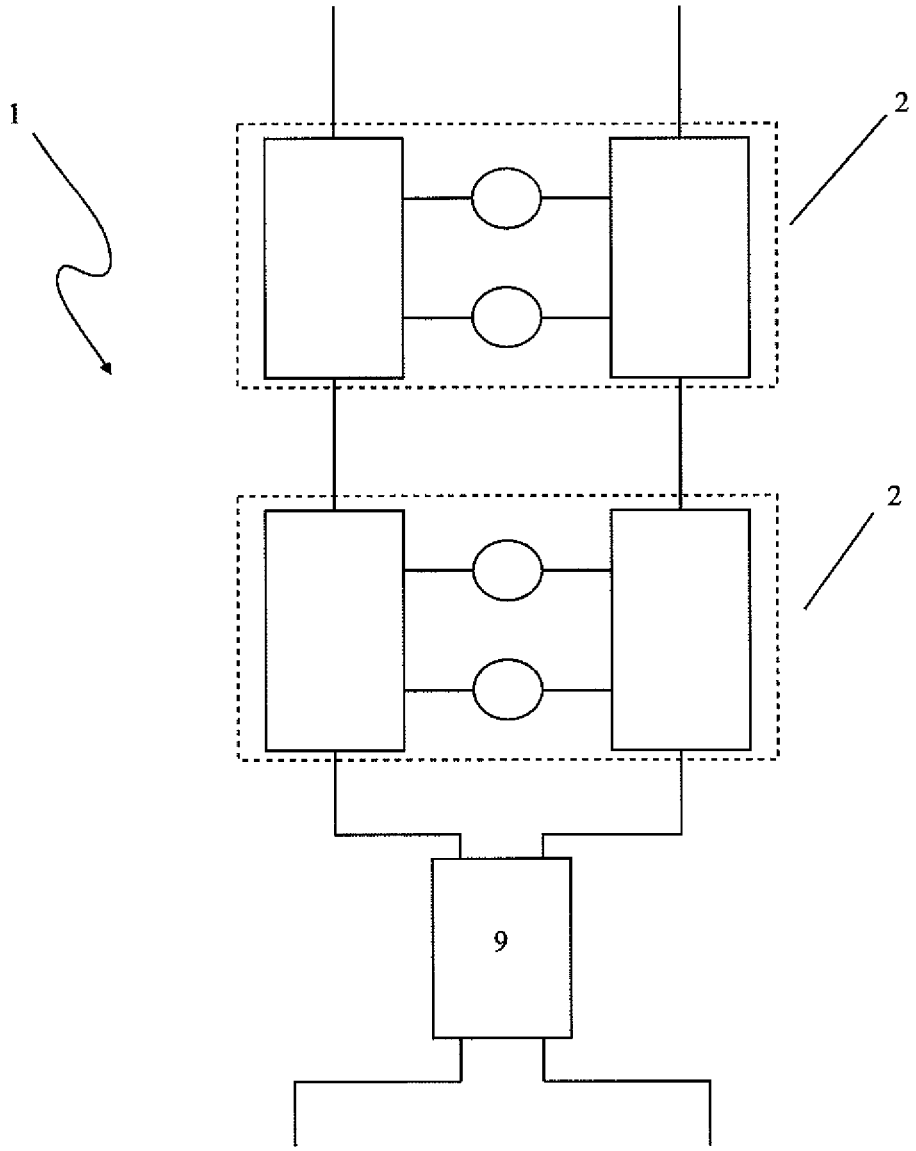
FIG. 4 shows a fourth embodiment of a band combining filter according to the invention.

Shown in FIG. 4 is a further embodiment of a band combining filter 1 according to the invention. In this embodiment the filter 1 is a second degree filter having a single band edge. One of the two filter sections 2 is a high Q filter section. The Q values of the resonators 26,27 of this section 2 are a factor of 8 higher than the Q values of the resonators 26,27 of the other filter section 2.

Figure 5:
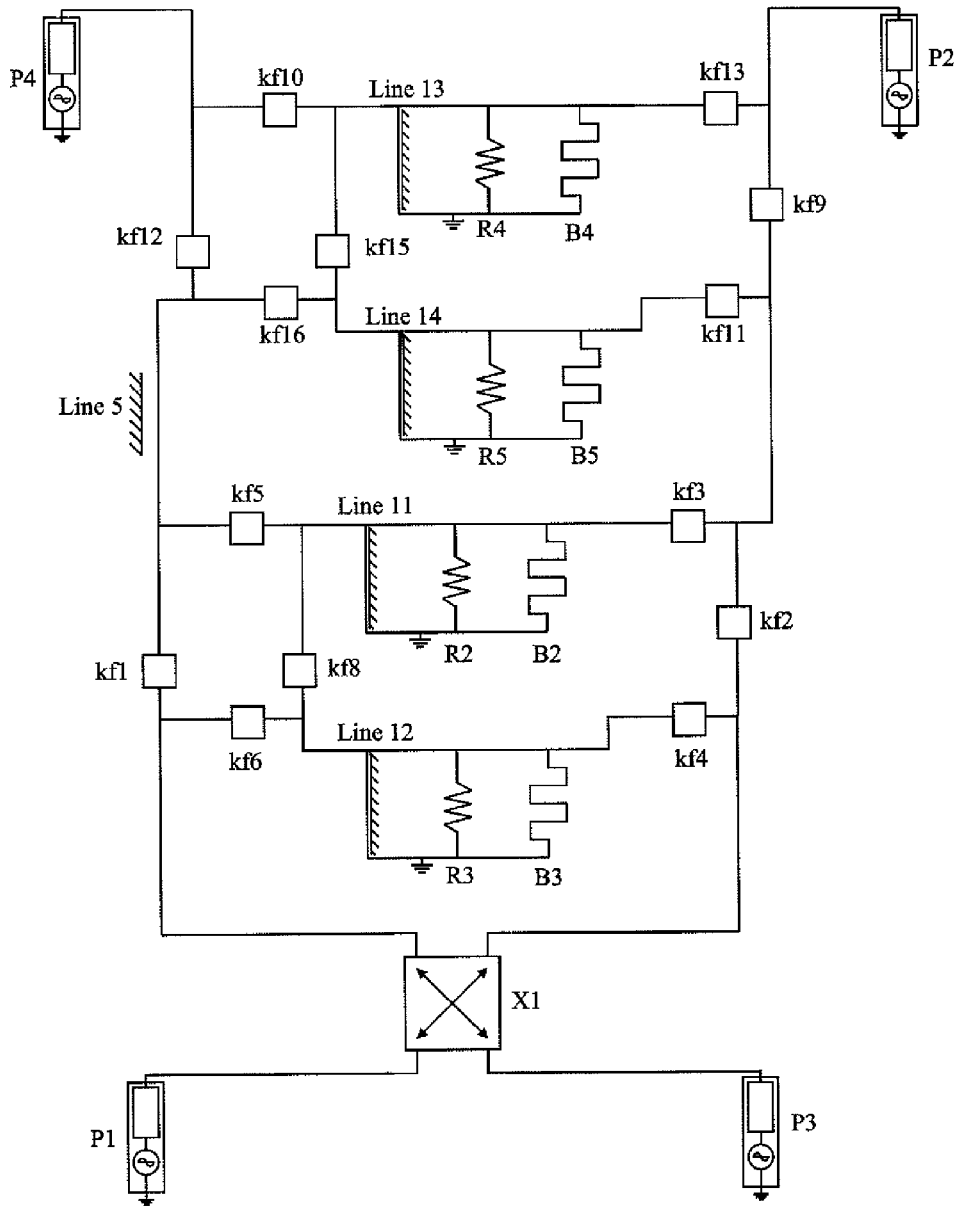
FIG. 5 shows a practical design of a band combining filter according to the invention.
Figure 6:
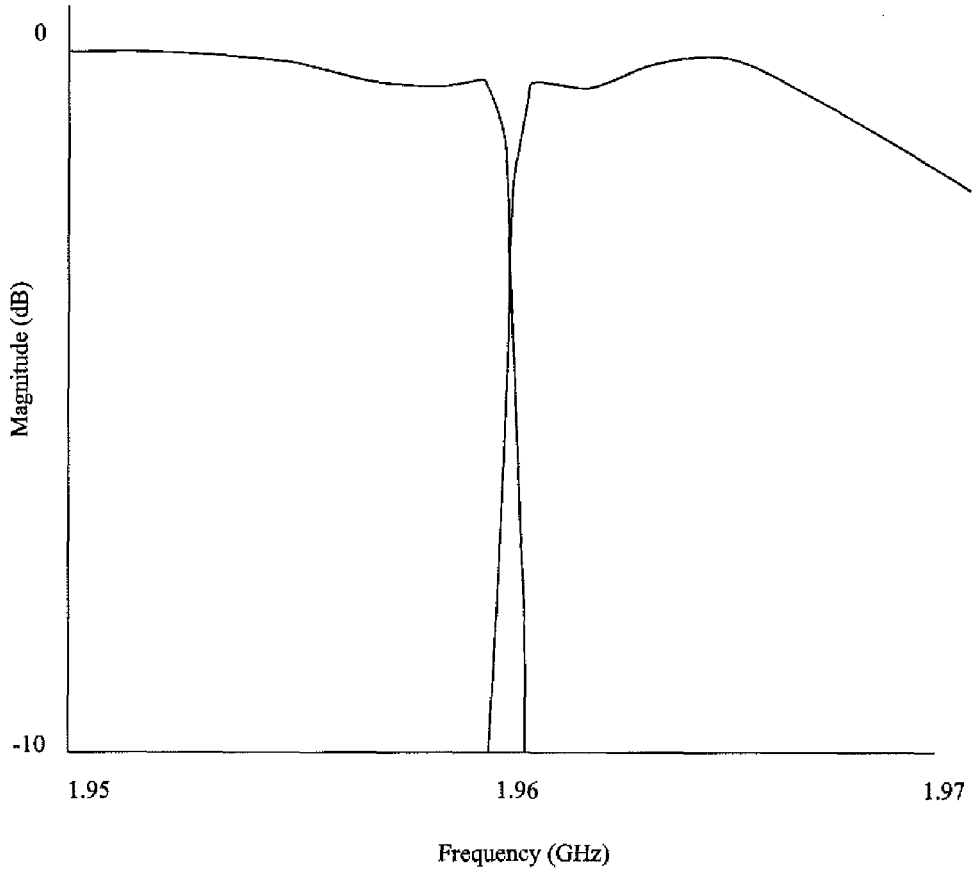
FIG. 6 shows the performance of the filter of FIG. 5.

Shown in FIG. 5 is a practical design of a second degree band combining filter 1 according to the invention. The Q values for the high Q filter section are set at 25,000 whilst those for the low Q filter section are set at 6000. Shown in FIG. 6 is the reflection and transmission performance of the filter as a function of frequency.

The operation of the band combining filter according to the invention is best described with reference to FIG. 7 and subsequent figures.

Figure 7:
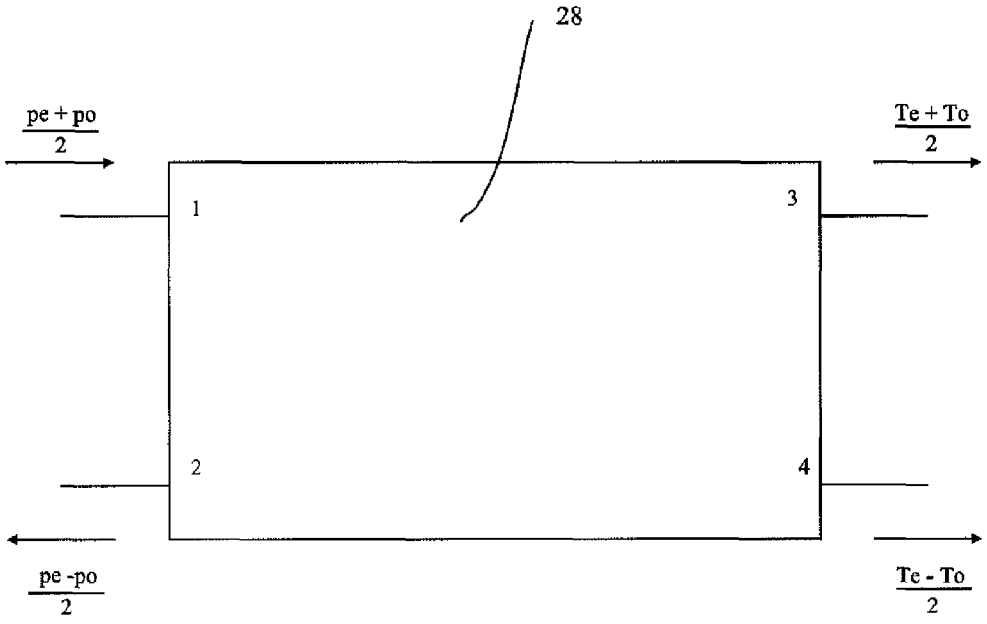
FIG. 7 shows a symmetrical four port structure.

Consider a symmetrical four port structure 28 as shown in FIG. 7 defined by its even and odd mode reflection and transmission coefficients.

For a Balanced Structure $$p_e = p_o = 0$$

and $$|T_e|^2 = |T_o|^2 = 1$$

defining $$T_e = \frac{1 - Y_e}{1 + Y_e}$$

$$T_o = \frac{1 - Y_o}{1 + Y_o}$$

Where $Y_e$ and $Y_o$ are obtained from a single two part filter one has—

$$S_{13} = \frac{T_e + T_o}{2} = \frac{1 - Y_e Y_o}{(1 + Y_e)(1 + Y_o)}$$

Which is the reflection coefficient of the equivalent two port filter and $$S_{14} = \frac{T_e - T_o}{2} = \frac{Y_o - Y_e}{(1 + Y_e)(1 + Y_o)}$$

Which is the transmission coefficient of the equivalent 2 port filter. Hence, signals in the passband emerge at port 4 and signals in the stopband emerge at port 3. Since the structure is reciprocal then the device acts as a combiner with signals in the passband applied at port 4 and signals in the stopband applied at port 3 both emerge at port 1 which would normally be connected to an antenna.

Considering the specific example given for the filter, in this case one has to realise two all pass networks, the first being $$T_e = \frac{1 - Y_e}{1 + Y_e}$$

Which becomes $$T_e = \left[\frac{1 + j(\sqrt{2} + 1)}{1 - j(\sqrt{2} - 1)}\right]\left[\frac{p - (\sqrt{2} + 1)}{p + (\sqrt{2} + 1)}\right] = e^{j\varphi}\left[\frac{p - (\sqrt{2} + 1)}{p + (\sqrt{2} + 1)}\right]$$

With $\phi = 2\tan^{-1}(\sqrt{2}+1)$ and, $$T_o = \frac{1 - Y_o}{1 + Y_o} = \left[\frac{1 - j(\sqrt{2} + 1)}{1 + j(\sqrt{2} + 1)}\right]\left[\frac{p - (\sqrt{2} - 1)}{p + (\sqrt{2} - 1)}\right] = e^{-j\varphi}\left[\frac{p - (\sqrt{2} - 1)}{p + (\sqrt{2} - 1)}\right]$$

Figure 8:
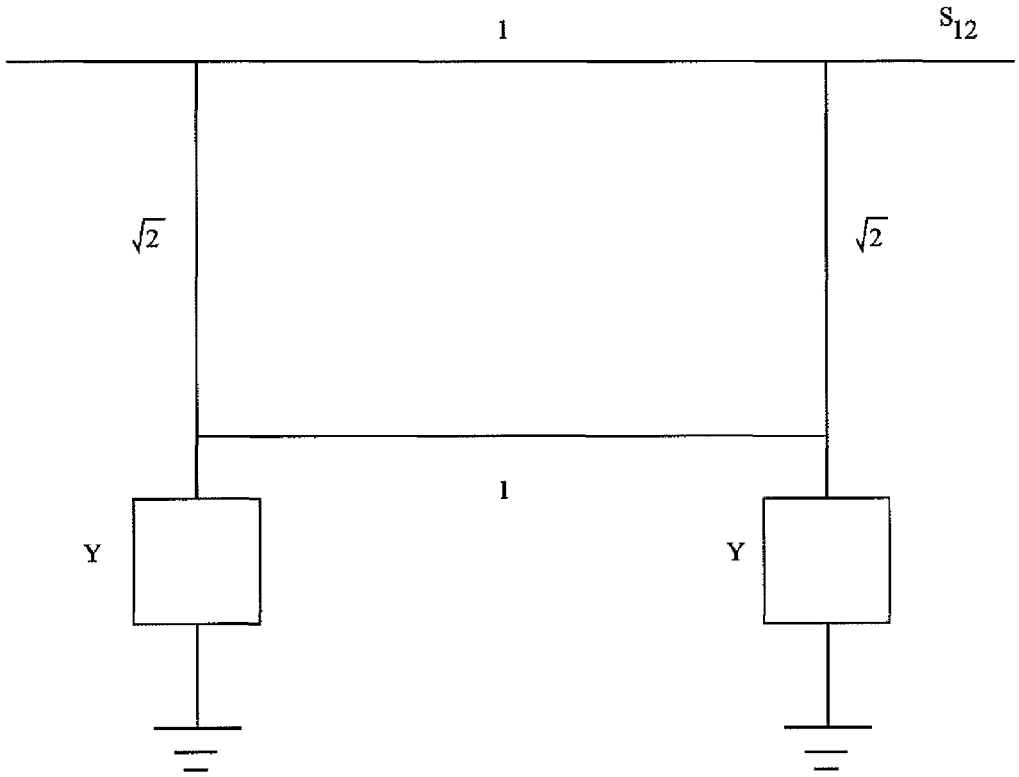
FIG. 8 shows a 3 dB hybrid with reactive admittances connected to two of the ports; and, FIGS. 9(*a*) to 9(*c*) show a sections which can be connected together in cascade to produce the filter of the invention.

Each all pass section can be realised with two equal reactive admittances connected to two of the ports of a 3 dB hybrid as shown in FIG. 8.

Figure 9A:
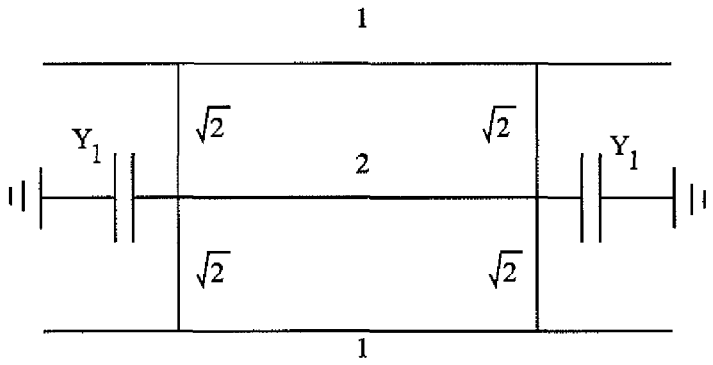
Figure 9B:
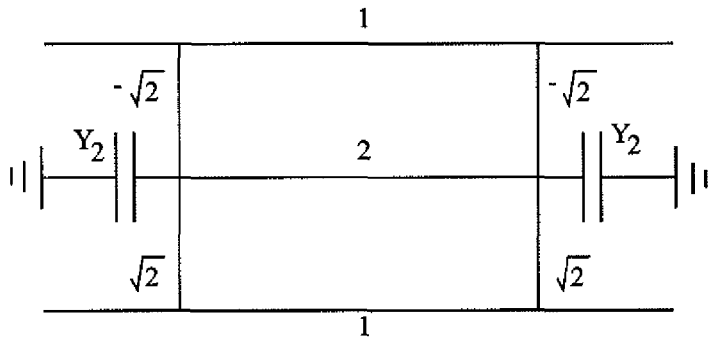
Figure 9C:
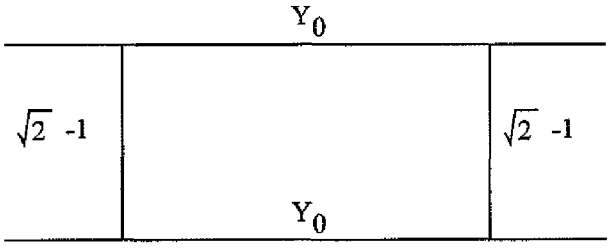

Hence, the resonant part of the even mode realisation is as shown in FIG. 9(*a*) and the odd mode is shown in FIG. 9(*b*) and the phase shifters required in the even and odd mode functions can be combined to form a single coupler shown in FIG. 9(*c*).

Hence, the whole band combining filter 1 is produced from the cascade of the sections shown in FIGS. 9(*a*) to 9(*c*) which can be cascades in any order.

The impedance ration between $Y_1$ and $Y_2$ is $(\sqrt{2}+1)^2$ thus enabling the resonator $Y_1$ to be realised with a Q factor considerably less than the resonator $Y_2$. In other words, with a band combining filter 1 having a structure according to the invention, provided the Q values of the resonators 26,27 of one filter section 2 are sufficiently high then the loss of the filter 1 across the passband is determined by that of the high Q resonators 26,27 only.

For higher degree networks the synthesis process is similar in that the transfer functions of the even and odd mode networks can be factorised as unity degree all pass factors as $$T_e = \frac{1 - Y_e}{1 + Y_e} = \prod_{r=0}^{N_e} \left(\frac{1 - Y_{er}}{1 + Y_{er}}\right)$$

and $$T_o = \frac{1 - Y_o}{1 + Y_o} = \prod_{r=0}^{N_o} \left(\frac{1 - Y_{or}}{1 + Y_{or}}\right)$$

where $N_e$ and $N_o$ are within one degree of each other and $Y_{er}$, $Y_{or}$ are of unity degree, $Y_{e0}$ and $Y_{o0}$ result in the frequency independent coupler 9. The overall realisation is the cascade of the independent filter sections 2 and the overall performance is independent of the order of the cascade.

Key for FIG. 5

| Label | Text |
|---|---|
| P4 | Z = 50 Ohms (source/load impedance) |
| (A power source/load) | |
| Kf10 | $Z_{ref}$ = Zhy1 Ohms (Inverter Impedance) |
| (A frequency dependent impedance inverter) | $Z_f$ = 0 Ohm/Hz (rate of change of impedance) |
| | $f_0$ = 0 Hz (reference frequency) |
| Line 13 | Z = 0.400274 Ohm (Line impedance) |
| (A transmission line) | L = 38.1969 mm (line length) |
| R4 | R = 12741 Ohm |
| (A resistor) | |
| B4 | B = 0.0057 mho |
| (A susceptance) | |
| Kf13 | $Z_{ref}$ = Zhy1 Ohms |
| (A frequency dependent impedance inverter) | $Z_f$ = 0 Ohm/Hz |
| | $f_0$ = 0 Hz |
| P2 | Z = 50 Ohms |
| (A power source/load) | |
| Kf12 | $Z_{ref}$ = 50 Ohms |
| (A frequency dependent impedance inverter) | $Z_f$ = 0 Ohm/Hz |
| | $f_o$ = O Hz |
| Kf15 | $Z_{ref}$ = Zhy3 Ohms |
| (A frequency dependent impedance inverter) | $Z_f$ = 0 Ohms/Hz |
| | $f_0$ = 0 Hz |
| Kf9 | $Z_{ref}$ = 50 Ohms |
| (A frequency dependent impedance inverter) | $Z_f$ = 0 Ohms |
| | $f_0$ = 0 Hz |
| Kf16 | $Z_{ref}$ = Zhy1 Ohms |
| (A frequency dependent impedance inverter) | $Z_f$ = 0 Ohms/Hz |
| | $f_0$ = 0 Hz |
| Line 14 | Z = 0.400274 Ohm |
| (A transmission line) | L = 38.1969 mm |
| R5 | R =12741 Ohm |
| (A resistor) | |
| B5 | B = 0.0057 mho |
| (A susceptance) | |
| Line 5 | Z = 50 Ohm |

-continued

| Label | Text |
|---|---|
| (A transmision line) | L = 76.4 mm |
| Kf5 | $Z_{ref}$ = Zhy2 Ohm |
| (A frequency dependent impedance inverter) | $Z_f$ = 0 Ohm/Hz |
| | $f_0$ = 0 Hz |
| Kf11 | $Z_{ref}$ = Zhy1 |
| (A frequency dependent impedance inverter) | $Z_f$ = 0 Ohm/Hz |
| | $f_0$ = 0 Hz |
| Line 11 | Z = 0.400274 Ohm |
| (A resistor) | L = 38.1969 mm |
| R2 | R = 300 Ohm |
| (A resistor) | |
| B2 | B = 0 mho |
| (A susceptance) | |
| Kf3 | $Z_{ref}$ = Zhy2 Ohm |
| (A frequency dependent impedance inverter) | $Z_f$ = 0 Ohm/Hz |
| | $f_0$ = o Hz |
| Kf1 | $Z_{ref}$ = 50 Ohm |
| (A frequency dependent impedance inverter) | $Z_f$ = 0 Ohm/Hz |
| | $f_0$ = 0 Hz |
| Kf8 | $Z_{ref}$ = Zhy4 Ohm |
| (A frequency dependent impedance inverter) | $Z_f$ = 0 Ohm |
| | $f_o$ = 0 Hz |
| Kf2 | $Z_{ref}$ = 50 Ohm |
| (A frequency dependent impedance inverter) | $Z_f$ = 0 Ohm |
| | $f_0$ = 0 Hz |
| Kf6 | $Z_{ref}$ = Zhy2 Ohm |
| (A frequency dependent impedance inverter) | $Z_f$ = 0 Ohm |
| | $f_0$ = 0 Hz |
| Line 12 | Z = 0.400274 Ohm |
| (A transimission line) | L = 38.1969 mm |
| R3 | R = 3000 Ohm |
| (A resistor) | |
| B3 | B = 0 mho |
| (A susceptance) | |
| Kf4 | $Z_{ref}$ = Zhy2 Ohm |
| (A frequency dependent impedance inverter) | $Z_f$ = 0 Ohm |
| | $f_0$ = 0 Hz |
| X1 | K = 0.32 (coupling value) |
| (A coupled phase shifter) | Phi = 90 degrees |
| P1 | Z = 50 Ohm (source/load impedance) |
| (A power source/load) | |
| P3 | Z = 50 Ohm (source/load impedance) |
| (A power source/load) | |

Zin1 = 335 Ohm

Zin2 = 97 Ohm $$Zhy1 = \frac{Zin1}{\sqrt{2}}$$

$$Zhy2 = \frac{Zin2}{\sqrt{2}}$$

$$Zhy3 = \frac{(Zin1)^2}{100}$$

$$Zhy4 = \frac{(Zin2)^2}{100}$$

The invention claimed is:

1. A band combining filter for filtering a microwave signal, the band combining filter having at least one band edge at a band edge transition frequency, the filter comprising:

a plurality of filter sections, each filter section comprising;

first and second 3 dB hybrid couplers, each 3 dB hybrid coupler comprising first and second input ports and first and second output ports;

a first resonator connected between the second input port of the first coupler and the first input port of the second coupler; and, a second resonator connected between the second output port of the first coupler and the first output port of the second coupler;

each filter section comprising first and second input ports defined by the first input port of the first coupler and the second input port of the second coupler respectively;

each filter section comprising first and second output ports defined by the first output port of the first coupler and second output port of the second coupler respectively;

the filter sections being connected in cascade with the first and second outputs of one filter section being connected to the first and second inputs of the next filter section in the cascade;

the band combining filter further comprising a coupled phase shifter in the cascade having first and second inputs adapted to receive microwave signals and provide microwave signals at output ports with a phase shift therebetween;

wherein a subset of the filter sections are high Q filter sections with the Q values of the resonators of those filter sections having values each of which are at least a factor of three higher than the Q values of the resonators of the remaining filter sections.

2. A band combining filter as claimed in claim 1, wherein the coupled phase shifter is the last element of the cascade with the inputs of the phase shifter receiving the outputs from the final filter section of the cascade.

3. A band combining filter as claimed in claim 1, wherein the coupled phase shifter is arranged between filter sections in the cascade.

4. A band combining filter as claimed in claim 1, wherein the Q values of the resonators in the subset are at least four times that of each of the remaining resonators.

5. A band combining filter as claimed in claim 1, wherein for each filter section the Q value of the first resonator in the filter section is equal to the Q value of the second resonator in the same filter section.

6. A band combining filter as claimed in claim 1, wherein the number of high Q filter sections is equal to the number of band edges.

7. A band combining filter as claimed in claim 6, having one band edge.

8. A band combining filter as claimed in claim 7, comprising two filter sections connected in cascade.

9. A band combining filter as claimed in claim 1, comprising at least three filter sections in cascade.

10. A band combining filter as claimed in claim 1, further comprising an electrical signal generator.

11. A band combining filter as claimed in claim 4, wherein the Q values of the resonators in the subset are at least five times that of each of the remaining resonators.

12. A band combining filter as claimed in claim 9, comprising at least four filter sections in cascade.

* * * * *